United States Patent [19]

Steyert

[11] Patent Number: 4,653,284

[45] Date of Patent: Mar. 31, 1987

[54] JOULE-THOMSON HEAT EXCHANGER AND CRYOSTAT

[75] Inventor: William A. Steyert, Center Valley, Pa.

[73] Assignee: Air Products and Chemicals, Inc., Allentown, Pa.

[21] Appl. No.: 625,925

[22] Filed: Jun. 29, 1984

[51] Int. Cl.[4] ..... F25D 17/06

[52] U.S. Cl. ..... 62/94; 62/475; 62/514 JT; 165/119

[58] Field of Search ..... 62/474, 475, 514 JT, 62/504, 511, 93, 94; 165/119

[56] References Cited

U.S. PATENT DOCUMENTS

| | | | |
|---|---|---|---|
| 2,448,315 | 8/1948 | Kunzog | 165/119 |
| 3,006,157 | 10/1961 | Halttinger et al. | 62/259 |
| 3,021,683 | 2/1962 | McInroy | 62/42 |
| 3,048,021 | 8/1962 | Coles et al. | 62/36 |
| 3,205,679 | 9/1965 | Geist et al. | 62/474 |
| 3,320,755 | 5/1967 | Jepsen et al. | 62/45 |
| 3,714,796 | 2/1973 | Longsworth | 62/514 |
| 3,728,868 | 4/1973 | Longsworth | 62/222 |
| 4,237,699 | 12/1980 | Longsworth | 62/514 JT |

*Primary Examiner*—Ronald C. Capossela

*Attorney, Agent, or Firm*—James C. Simmons; E. Eugene Innis

[57] ABSTRACT

Fibrous material disposed in the Joule-Thomson orifice and/or the high pressure tube of a Joule-Thomson heat exchanger provides an effective flow restrictor in the orifice and means to prevent blockage because of contaminants in the fluid freezing and clogging the orifice. A Joule-Thomson device of this type can be fabricated for use as a cryostat to be disposed in confined space.

29 Claims, 4 Drawing Figures

JOULE-THOMSON HEAT EXCHANGER AND CRYOSTAT

The government has rights to this invention pursuant to contract No. N60530-83-C-0119 awarded by the United States Department of Defense Naval Weapons Center, China Lake, Calif.

TECHNICAL FIELD

This invention pertains to cryogenic refrigeration systems, most commonly referred to as cryostats, used in cryo-electronic systems such as cooling infra-red detectors and the like. These systems are useful in both fixed ground operations and in airborne detection systems. Such systems produce refrigeration by expansion of gas through an orifice which is the well-known Joule-Thomson effect or cooling cycle.

BACKGROUND OF THE PRIOR ART

Cryostats employing the well-known Joule-Thomson effect or cooling cycle are shown in U.S. Pat. Nos. 3,006,157, 3,021,683, 3,048,021, 3,320,755, 3,714,796, 3,728,868, and 4,237,699. All of the cryostats shown in the foregoing patents rely upon devices to achieve the Joule-Thomson effect that would prevent such a refrigeration device from being disposed in a confined location or require moving parts to cause flow restriction.

SUMMARY OF THE INVENTION

An effective flow restrictor can be achieved in a Joule-Thomson (JT) heat exchanger by inserting a fine fibrous material (composed of individual fibers) into the high pressure tube at what would normally be the outlet and crushing or deforming the tube over the fiber to create the flow restrictor. Fibers or a fibrous or non-fibrous hydrophilic material can also be inserted in other portions of the high pressure tube to absorb water and minimize the migration of ice crystals to the flow restrictor and prevent ice blockage within the restrictor. Furthermore, when the JT orifice is part of a tube-in-tube heat exchanger with the high pressure tube disposed inside the low pressure tube and the low pressure tube is deformed to cause intimate contact with the high pressure tube at certain locations along the heat exchanger, heat transfer between the high and low pressure tubes can be enhanced.

DETAILED DESCRIPTION OF THE INVENTION

In order to develop small Joule-Thomson coolers to deliver refrigeration for cooling an object such as an infra-red detector, one of the most difficult problems to overcome was development of a low flow Joule-Thomson (JT) flow restrictor which is not prone to blockage of its necessarily tiny passages. Blockage comes about by virtue of water vapor in the refrigeration gas (e.g. argon), which as the temperature of the gas decreases on its way toward the JT orifice, the water freezes with the resulting ice crystals tending to block the necessarily small JT orifice.

In prior art devices, small, low flow rate (low gas consumption) cryostats with a fixed orifice are limited to a 0.004 inch (0.1 mm) minimum inside diameter JT flow restrictor tube. Tubes smaller than this are easily blocked by minute, unavoidable impurities in the gas stream. A 0.004 inch (0.1 mm) tube used as a flow restriction in the JT system requires a comparatively large gas flow in order to maintain the pressure drop required for JT operation. The large gas flow dictates a large heat exchanger, the smallest current JT refrigerators being 1.1 inch long. Thus, a lower flow rate refrigerator could be achieved if a sub-miniature demand flow JT valve mechanism were available or if a high flow impedance could be developed which is not prone to flow blockage by impurities.

Figure 1:
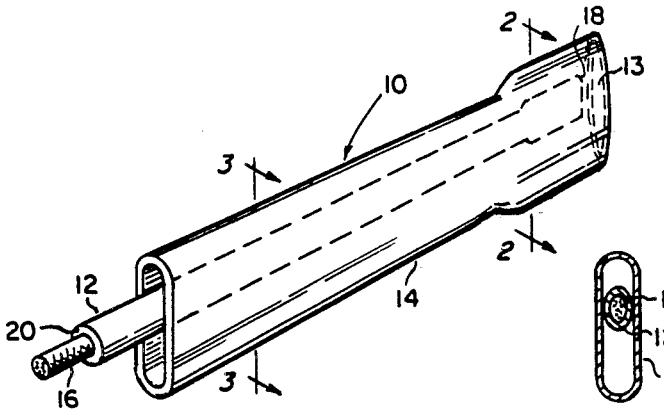
FIG. 1 is an enlarged perspective view of a heat exchanger according to the present invention.
Figure 3:
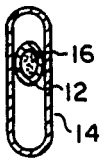
FIG. 3 is a section taken along line 3—3 of FIG. 1.
Figure 2:
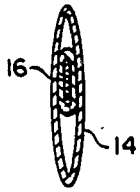
FIG. 2 is a section taken along line 2—2 of FIG. 1.

After numerous attempts at designing a cryostat utilizing a Joule-Thomson heat exchanger and Joule-Thomson orifice, a device such as shpown in FIG. 1 was developed. As shown in FIG. 1, the heat exchanger 10 includes an inner or high pressure tube 12 disposed within an outer or low pressure tube 14. End 13 of low pressure tube 19 is sealed as by soldering. Disposed within high pressure tube 12 is an elongated fibrous material 16. As shown in FIG. 2, the end 18 of tube 12 which will be designated the orifice end is crushed over the thread to provide the flow restrictor. As shown in FIG. 3, the low pressure tube 14 is deformed along at least a portion of its length and preferably all of its length to provide intimate contact between the low pressure tube 14 and the high pressure tube 12 to enhance heat transfer between the two.

The heat exchanger of FIG. 1 is preferably constructed from stainless steel tubing and the preferred fiber is a mercerized cotton or other hydrophilic material (fibers, zeolite resins and the like), although fine fibers of silk, glass, metal or plastic would work. If cotton fiber or other hydrophilic material is disposed through the length of the high pressure tube, it can act to absorb moisture in that region where the gas has not been cooled enough to cause ice to form. Furthermore, cotton or any other fiber can serve to prevent migration of ice crystals to the orifice after they are formed upstream of the orifice. Lastly, all fibers can be used in conjunction with deformation of the end of the high pressure tube to form an orifice with an effective flow restrictor.

In the device of FIG. 1, the end 20 of the high pressure tube 12 is connected to a source of high pressure gas such as argon. As the gas moves from end 20 toward end 18 of the high pressure tube, it is cooled. Condensable impurities in the gas (e.g. water) condense to form a mist of ice crystals in the gas and/or form a deposit on the tube walls. The fibers in the heat exchange section prevent the migration of the ice crystals to the flow restrictor. The function of the fiber in the flow restrictor (crushed section of the tube as shown in FIG. 2) is to:

(a) provide a labyrinth of fibers that are somewhat tolerant of ice, at least compared with single, minute flow passage as is currently used in the art, and (b) prevent accumulation of ice at one cross-sectional location through the movement of ice through the restrictor.

The presence of the fine fibrous in the tube and flow restrictor prevent contamination migration which is believed to be the key to successful operation of a device of this type. Thus, the use of large components, such as intricate needles and control mechanisms or sintered metal units (cylinders 1/16 in diameter and 1/16 in long are the smallest available) are not required and a small cryostat can be achieved.

A device according to FIG. 1 is constructed wherein the high pressure tube 12 is 0.022 inches (0.56 mm) OD by 0.0115 inches (0.24 mm) ID, which is filled with parallel lengths of fine cotton thread (size 50). The gas, after passing through the crushed section at end 18 (FIG. 2) is at a low pressure and moves from the right to the left through the low pressure tube 14 0.04 inches (1.0 mm) OD by 0.03 inches (0.75 mm) ID. As shown in the drawing, the low pressure tube has been deformed or crushed in order to be put in good thermal contact with the inner high pressure tube in order to effect pre-cooling of the high pressure fluid as it travel to the orifice end 18 of tube 12.

Figure 4:
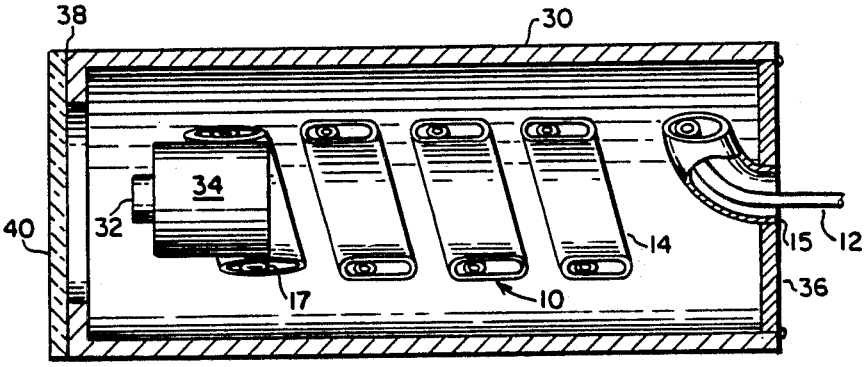
FIG. 4 has an enlarged cross-sectional view of the heat exchanger of the present invention configured for cooling an infra-red detector.

FIG. 4 shows a Joule-Thomson heat exchanger 10 according to the present invention disposed inside of a vacuum housing 30 to be used as a cryostat to cool an infra-red detector 32. As shown in FIG. 4, a portion of helically wound heat exchanger 10 is disposed around and in intimate contact with an infra-red detector heat station 34. Heat station 34 can be fixed to the inner wall of housing 30 by supports (not shown) which have low heat conductivity properties. Heat exchanger 10 is supported by being soldered to cover 36 of housing 30. Housing 30 has disposed on its forward end 38 an infra-red window. Heat exchanger 10 includes a high pressure tube 12 which on one end extends beyond low pressure tube 14 outwardly of housing 30 to facilitate connecting tube 12 to a source of high pressure fluid, e.g., argon. Tube 12, on the other end, terminates in a Joule-Thomson orifice 17 adjacent heat station 34. As shown in FIG. 4, the heat exchanger 10 terminates at heat station 34 so that the heat station 34 can be effectively cooled and transmit refrigeration to I-R detector 32.

A refrigerator of this type was found to cool the heat station 34 to less than 100° K. for one hour when supplied by gas at 1600 psi (10.9 MPa) or greater. Gas flows of 4 standard cubic centimeters per second or greater of argon were required.

Having thus described my invention, what is desired to be secured by Letters Patent of the United States is set forth in the following claims.

I claim:

1. In a refrigerator of the type wherein a fluid is passed through the high pressure tube of a heat exchanger and then expanded through a Joule-Thomson orifice to produce refrigeration proximate the Joule-Thomson orifice, the improvement comprising:

fibrous material disposed in the Joule-Thomson orifice which is deformed to fix said fibrous material in place, whereby said fibrous material and deformed orifice result in an orifice with large flow impedance.

2. A refrigerator according to claim 1 wherein said heat exchanger is a tube-in-tube heat exchanger wherein a portion of the inner tube intimately contacts the wall of the outer tube.

3. A refrigerator according to claim 1 wherein said fibrous material is made of cotton fiber.

4. A refrigerator according to claim 1 wherein said fibrous material is hydrophilic fiber.

5. A refrigerator according to claim 1 wherein said fibrous material is made of silk fibers.

6. A refrigerator according to claim 1 wherein said fibrous material is made of synthetic fibers.

7. A refrigerator according to claim 1 wherein said fibrous material is disposed throughout the length of the high pressure tube.

8. A method of preventing the blocking of the orifice in a Joule-Thomson heat-exchange refrigerator having a high pressure tube with an inlet and an outlet comprising the steps of:

inserting a fibrous material throughout the entire length of the high pressure tube to absorb moisture and/or prevent migration of ice crystals to the outlet of said tube.

9. A method according to claim 8 wherein said material is a hydrophilic material.

10. A method according to claim 8 wherein said material is fibrous.

11. A method according to claim 10 wherein said fibrous material is cotton thread.

12. A method according to claim 10 wherein the outlet of said high pressure tube is deformed over said fibrous material to form an orifice with a high flow impedance.

13. A method according to claim 8 wherein said refrigerator includes a tube-in-tube heat exchanger.

14. A Joule-Thomson cryostat capable of cooling an object to less than 100° K. and capable of being disposed in a vacuum space or insulating media comprising, in combination:

a tube-in-tube heat exchanger deformed along the length of the outer tube to enhance heat exchange between said inner and outer tubes of the heat exchanger, one end of said inner tube adapted to be connected to a source of high pressure fluid with the other end of said tube defining a Joule-Thomson orifice; and a length of fibrous material fixed within at least the portion of the inner tube defining the Joule-Thomson orifice to provide a flow restrictor.

15. A cryostat according to claim 14 wherein said fibrous material is disposed along the entire length of said inner tube.

16. A cryostat according to claim 14 wherein said fibrous material is cotton thread.

17. A cryostat according to claim 14 wherein said fibrous material is silk thread.

18. A cryostat according to claim 14 wherein said fibrous material is made of synthetic fibers.

19. A cryostat according to claim 14 wherein said fibrous material is a hydrophilic fiber.

20. A cryostat according to claim 19 wherein said fibrous material is cotton thread.

21. In a refrigerator of the type wherein a fluid is passed through the high pressure tube of a heat exchanger and then expanded through a Joule-Thomson orifice to produce refrigeration proximate the Joule-Thomson orifice, the improvement comprising:

a material disposed throughout the entire length of the high pressure tube upstream of the orifice whereby said material can absorb moisture from said high pressure gas and/or intercept ice crystals before they approach the Joule-Thomson orifice.

22. A refrigerator according to claim 21 wherein said heat exchanger is a tube-in-tube heat exchanger wherein a portion of the inner tube intimately contacts the wall of the outer tube.

23. A refrigerator according to claim 21 wherein said material is hydrophilic.

24. A refrigerator according to claim 21 wherein the material is fibrous.

25. A refrigerator according to claim 24 wherein said fibrous material is made of cotton fiber.

26. A refrigerator according to claim 24 wherein said fibrous material is made of hydrophilic fiber.

27. A refrigerator according to claim 24 wherein said fibrous material is made of silk fibers.

28. A refrigerator according to claim 24 wherein said fibrous material is made of synthetic fibers.

29. A refrigerator according to claim 24 wherein said fibrous material is disposed throughout the length of the high pressure tube and in said Joule-Thomson orifice which is deformed to fix such fibrous material in place.

* * * * *